US005726619A

United States Patent [19]

Hohorst et al.

[11] Patent Number: 5,726,619

[45] Date of Patent: Mar. 10, 1998

[54] TRANSFORMER TERMINAL

[75] Inventors: Wolfgang Hohorst, Minden; Lothar Roland Hennemann, Enger, both of Germany

[73] Assignee: Wago Verwaltungsgesellschaft mbH, Minden, Germany

[21] Appl. No.: 607,475

[22] Filed: Feb. 27, 1996

[30] Foreign Application Priority Data

Mar. 2, 1995 [DE] Germany ..... 195 08 695.3

[51] Int. Cl.[6] ..... H01F 27/29; H01F 27/02

[52] U.S. Cl. ..... 336/192; 336/90

[58] Field of Search ..... 336/65, 82, 83, 336/90, 92, 192, 198

[56] References Cited

U.S. PATENT DOCUMENTS

| | | | |
|---|---|---|---|
| 4,027,279 | 5/1977 | Shigehara | 336/90 |
| 4,499,522 | 2/1985 | Nakamura | 336/90 |
| 4,713,642 | 12/1987 | Wolfe et al. | 336/92 |
| 5,124,680 | 6/1992 | Maekawa | 336/192 |
| 5,165,056 | 11/1992 | Chien-heng | 336/192 |
| 5,239,278 | 8/1993 | Andres | 336/65 |

FOREIGN PATENT DOCUMENTS

| | | |
|---|---|---|
| 0 122 377 | 2/1984 | European Pat. Off. . |
| 32 24 063 A1 | 1/1984 | Germany . |

*Primary Examiner*—Matthew V. Nguyen
*Attorney, Agent, or Firm*—Salter & Michaelson

[57] ABSTRACT

The invention concerns a transformer terminal, which consists of two parts according to the instructions of the invention, i.e., a saddle contact, which has the internal connection unit and which locks onto the coil unit of the transformer or is configured in one piece with the latter, and a slide contact for the external wiring, preferably in the form of individual terminals that can be arranged in series, which can be plugged onto the saddle contact. In this way, a very easily accessible and robot-accessible arrangement of the internal connection units is achieved, which assures, however, a complete contact protection also for the transformer terminals mounted in the finished state.

6 Claims, 4 Drawing Sheets

TRANSFORMER TERMINAL

BACKGROUND OF THE INVENTION

The invention concerns a transformer terminal with an insulation-material housing, the transformer terminal being attached directly to an insulation-material coil unit of the transformer, and has at least one internal connection unit for connecting a winding wire of the transformer as well as at least one external connection unit for the external wiring of the transformer.

Such transformer teals are known. They are conventionally connected to the coil unit of the transformer after manufacture of the transformer. For this purpose, the latter is provided with integrated assembly chambers (connection chambers), in which the transformer terminals formed as single or double terminals are connected by means of an assembly foot shaped on the insulation-material terminal housing.

After connecting the transformer terminals to the coil unit of the transformer, the winding wires of the transformer must be connected to the respective internal connection units of the transformer teals. This is done in such a way that the ends of the winding wires or (in the case of center tappings) loop-shaped partial pieces of the winding wires are let out from the coil winding of the transformer and are preferably joined by soldering to the internal connection unit of the transformer terminals. Such a soldering connection has the advantage that it can be reliably designed electrically despite the lacquer- insulation layer of the winding wires, since the latter fuse in the soldering process.

However, the internal solder connection also has disadvantages. It is relatively expensive with respect to manufacture and it also cannot be designed in a cost- favorable manner, if robots are used in the production for applying the winding wires to the respective internal solder connection units and for the solder process itself. Robots require a continual free and open access to the solder-connection units, especially since in the application of the winding wires to the solder connection unit of the robot head, movement runs must be designed in different directions. This condition of open accessibility of the internal connection units comes up against the additional requirement that the transformer terminals must have as complete a contact protection as possible. In practice, therefore, hinged or loose covering caps made of insulation material for transformer terminals are known, which are placed on the transformer terminals after soldering on the winding wires.

SUMMARY OF THE INVENTION

The object of the invention is to develop a transformer terminal, whose internal connection can be executed more simply and in a more cost-favorable manner by means of a robot and which assures, however, full contact protection after the final assembly.

This object is resolved according to the invention in that the transformer terminals consist of two parts, i.e., an internal connection part with the internal connection unit (called the saddle contact in the following), which is attached to the coil unit, and an external contact part with the external connection unit (called the slide contact in the following), which can be placed on the saddle contact, whereby an electrical connection is made between the saddle contact and the slide contact. Thus, the connection unit of the saddle contact is openly accessible before placement of the slide contact, and after placement of the slide contact, it is covered in a contact-secure manner by means of the insulation-material housing of the slide contact.

By means of its saddle contact and its slide contact, the new two-part transformer terminal fulfills, in a much better way, the various conditions of open accessibility and an internal connection that is simple to manufacture on the one hand, and the complete contact protection of the transformer terminal, on the other hand.

The saddle contact possesses an insulation-material housing, which is either locked with the coil unit of the transformer or which is manufactured according to an appropriate form of embodiment of the invention in one piece with the insulation material coil unit of the transformer. It is always true that the saddle contact, which is attached first alone to the coil unit (i.e., without the corresponding slide contact), makes possible a much freer and more open access to the internal connection unit of the transformer terminal than is the case for previously known transformer terminals.

In the case of a particularly advantageous form of embodiment of the invention, the internal connection unit of the saddle contact is given by a contact knife, which has a fork-shaped knife slot, in which a winding wire can be shifted without problem, with the wire insulation that is present, by means of a robot, since such fork-shaped contact knives contact the respective winding wire free of insulation.

The foot part of such a contact knife is held in the insulation-material housing of the saddle contact in such a way that the head part of the contact knife with the fork-shaped knife slot extends from the coil unit freely and openly and is accessible crosswise to the principal axis of the coil unit, so that a robot head has no problem traveling up to the fork-shaped knife slot of the contact knife and pressing a winding wire into the knife slot. The internal connection of the new transformer terminal is produced in this way, without producing unfavorable heat loads on the coil windings of the transformer, which cannot be avoided in the conventional soldering process.

Of particular importance is the form of embodiment of the invention, in which the foot part of the contact blade can be plugged into the finished extruded insulation-material housing of the saddle contact and locked in the latter. This type of mounting of the foot part of the contact knife provides the possibility of using different contact knives selectively. Correspondingly, the correct contact knives with the correctly dimensioned knife slot for the respective diameter of the winding wires to be connected can be plugged into the insulation-material housing of the saddle contact each time.

The selection of the slide contact, which can be placed on the saddle contact after the internal connection is made is independent of this. The slide contact may also be varied with respect to the desired connection cross section for external wiring, whereby, e.g., spring-force terminal connections, screw or flat plug connections, can be used.

As a result, due to the exchangeability of the internal contact unit and due to the exchangeability of the slide contacts that can be placed on it, the two-part transformer terminal has a large variability for the adaptation of new transformer terminals to the transformers dimensioned in various ways in practice.

An appropriate form of embodiment of the invention provides for producing electrical connections between the saddle contact and the slide contact, so that the internal connection unit of the saddle contact has a plug uptake, in which a plug-in tab of the external connection unit of the slide contact engages the saddle contact when the slide contact is introduced.

It is also of advantage that in the case of the transformer terminal according to the invention, slide contacts can be produced with an insulation-material housing, which have a disk-shaped configuration, i.e., the form of terminals that can be arranged in series, whose insulation-material housing can be locked together to form a modularly structured terminal block. With the use of terminals that can be arranged in series, as slide contacts, all those advantages and techniques may be utilized, which are known for terminals arranged in series.

BRIEF DESCRIPTION OF THE DRAWINGS

Examples of embodiment of the invention will be described in more detail below on the basis of the drawings.

DETAILED DESCRIPTION OF THE PREFERRED EMBODIMENTS

Figure 1:
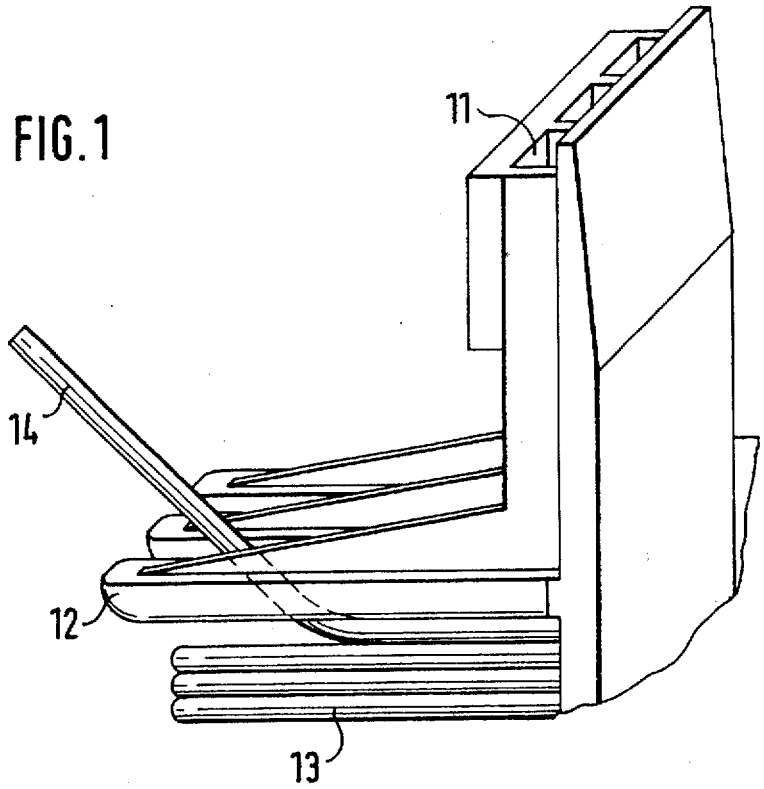
FIGS. 1–5 show a first example of embodiment of the invention.

FIG. 1 shows as a partial section the upper region of a coil unit of insulating material, as it is known for transformers as a so-called connection chamber/coil unit for transformers. Connection chambers 11 extend as shown in the drawing of FIG. 1 from top to bottom and are parallel to the principal axis of the coil unit. The connection chambers are each open at the top and at the lower end. Crosswise to the principal axis of the coil unit, digit pieces 12 extend, the digit pieces bounding the winding space for coil windings 13 and make possible a guiding out of ends 14 of winding wires and/or loop-shaped partial pieces of the winding wires.

Figure 2:
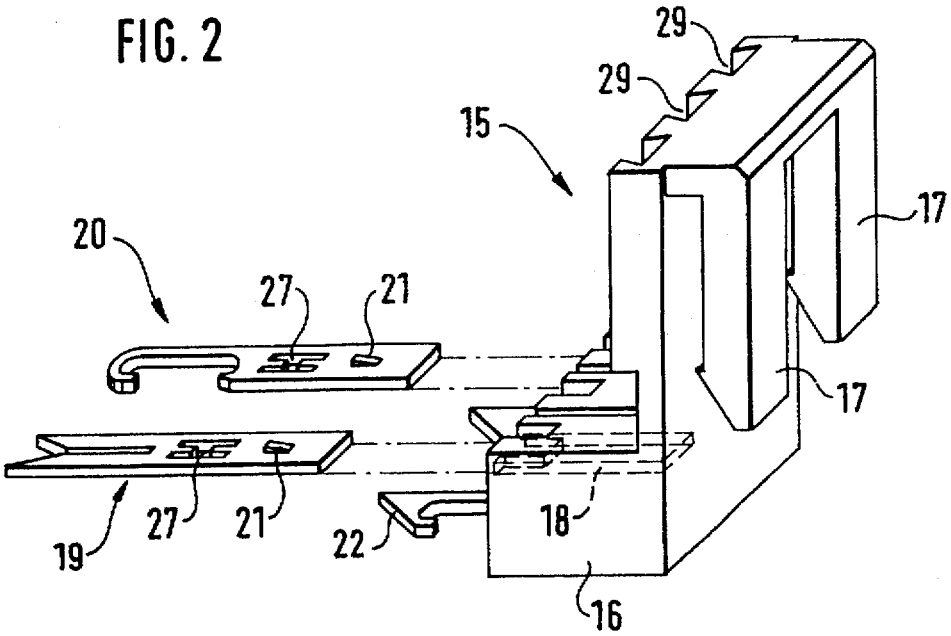

FIG. 2 shows a saddle contact 15 of the new transformer terminal. The saddle contact possesses the insulation- material housing 16 with connection feet 17, which serve for attaching the saddle contact to the coil unit shown in FIG. 1 by plugging the latter into connection chambers 11 of the coil unit. Holding slots 18 are present in the insulation-material housing 16, in which the foot parts of a fork-shaped contact knife 19 or of a solder hook 20 can be plugged in as desired. The foot parts each possess ratchets 21 for attaching the foot parts in the respective holding slots 18. If needed, holding pieces 22 may also be inserted in insulation-housing material 16 in corresponding additional uptake slots, which hold the end 14 of the winding wire rigidly, as FIG. 4 shows.

Figure 4:
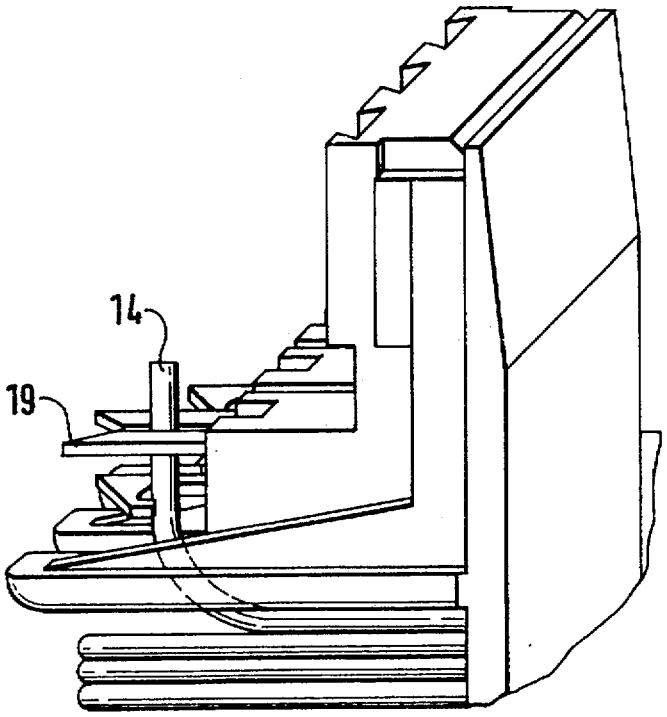

FIG. 4 shows saddle contact 15, as it is shown in FIG. 2, but in the locked state with the upper part of the coil unit shown in FIG. 1. After the saddle contact is attached or looked in the coil unit, end 14 of the winding wire that is shown is pressed into the fork-shaped knife slot of contact knife 19, whereby the winding wire contacts the contact knife (internal connection unit) free of insulation.

Figure 3:
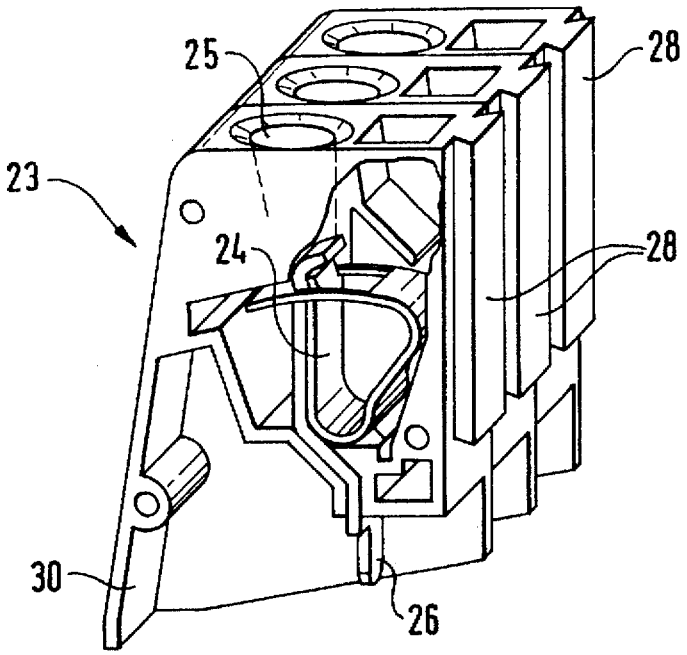

FIG. 3 shows slide contacts 23, which are configured in the form of serial terminals, whose insulation-material housing can be locked to form a terminal block. Each terminal possesses for the external wiring an external connection unit, which is formed by a terminal force spring connection 24 in the case of the example of embodiment that is shown. These terminal force spring connections are well known in the state of the art. The external conductor that is to be connected is guided over conductor plug-in opening 25 of the respective terminal position.

What is novel is that the busbar of the terminal force spring connection 24 has a plug-in tab 26 directed downwardly, which engages in a plug uptake 27 formed in the foot part of contact knife 19 (or soldering hook 20) when slide contact 23 is placed on saddle contact 15. In this way, not only the electrical connection between the slide contact and the saddle contact are produced, but also the contact knife used each time (or the soldering hooks) is attached so that it cannot be loosened in the saddle contact.

Slide contact 23 on saddle contact 15 is introduced in such a way that the dovetail 28 present on the slide contact is inserted into the respectively arranged dovetail groove 29 of the saddle contact. Thus, the outer protection wall 30 of slide contact 23 overlaps the internal connection units 19 or 20 that are accessible and open, so that the required contact protection is given in the case of the transformer terminal that is mounted in the finished state.

Figure 5:
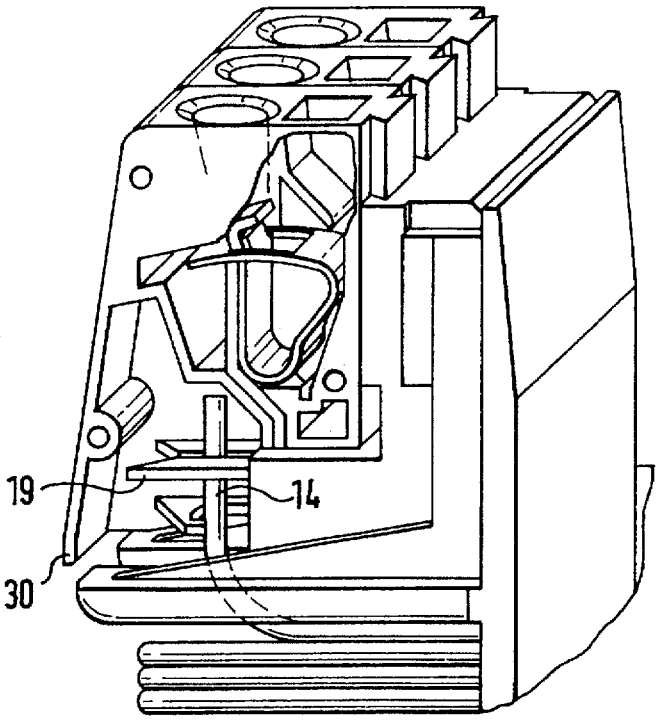

FIG. 5 shows the new transformer terminal, as it has been described above on the basis of FIGS. 1 to 4, in the finished mounted state on the coil unit of the transformer.

Figure 6:
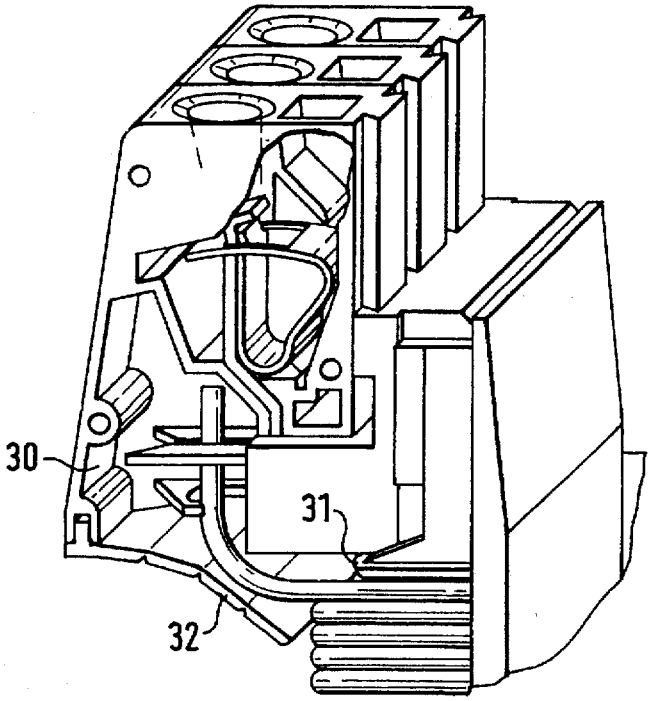
FIG. 6 shows a second example of embodiment of the invention.

FIG. 6 shows in principle the same transformer terminal as in FIG. 5, but digit pieces 31 are shortened in FIG. 6 (in comparison to digit pieces 12 in FIG. 5 or in FIG. 1), as this can also be seen in practice in the case of coil units. In this case, it is appropriate to engage an additional contact covering 32 for a complete contact protection at the lower edge of protection wall 30.

Figure 7:
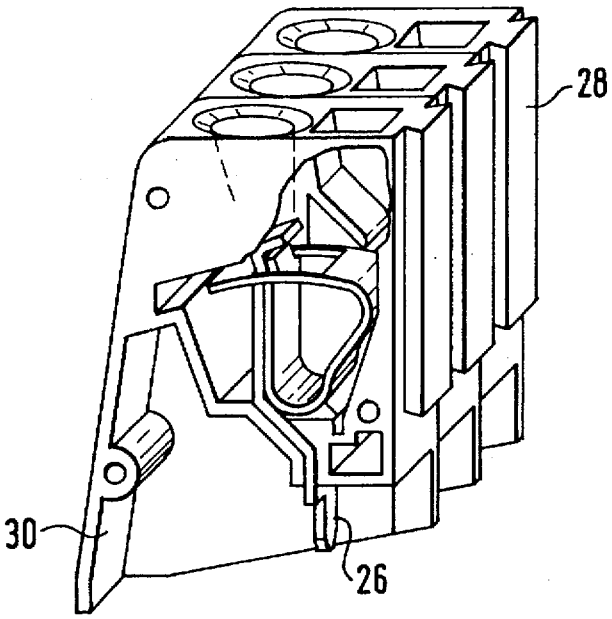
FIGS. 7 and 8 show a third example of embodiment of the invention.
Figure 8:
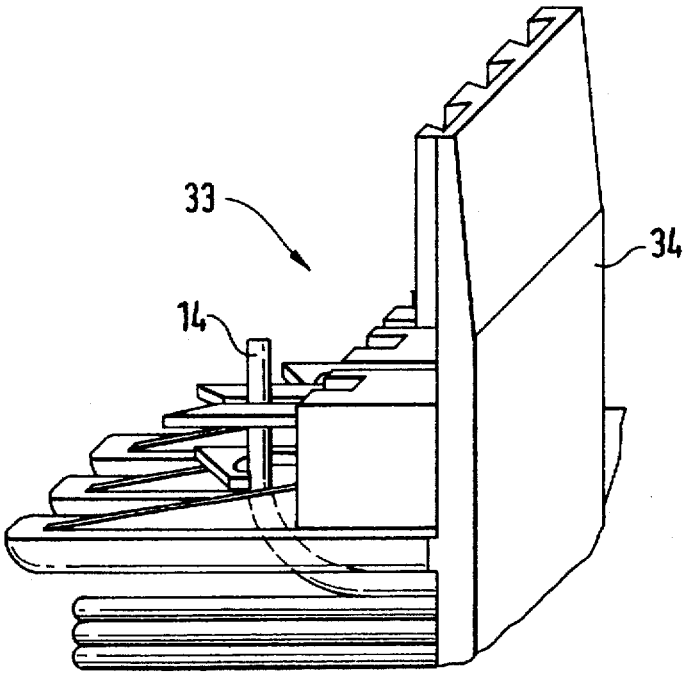

FIGS. 7 and 8 show an example of embodiment of the invention, in which saddle contact 33 is configured in one piece with the insulation-material coil unit, so that only the slide contact shown in FIG. 7 is to be placed on the saddle contact according to FIG. 8 for the finished assembly of the transformer terminal.

What is claimed is:

1. A transformer terminal having an insulation material housing, the transformer terminal being attached directly to an insulation material coil unit, the transformer terminal having at least one internal connection unit for the connection of a winding wire of the transformer as well as at least one external connection unit for the external wiring of the transformer, said transformer terminal comprising:

two parts detachable from each other, including an internal saddle contact part having the internal connection unit, the internal saddle contact part being attached to the coil unit; and an external slide contact part having the external connection unit and being placed on the saddle contact part, whereby an electrical connection is made between the saddle contact part and the slide contact part, said internal connection unit of the saddle contact part being open and accessible prior to the placement of the slide contact part and being covered in a contact secure manner by means of the insulation material housing of the slide contact part after the slide contact part is placed on the saddle contact part.

2. The transformer terminal as set forth in claim 1, said internal connection unit of the saddle contact part being configured as a fork-shaped contact knife having a foot part which is held in the insulation material housing of the saddle contact part, and a head part which extends out crosswise from a principle axis of the coil unit, said head part having an open and accessible fork-shaped knife slot.

3. The transformer terminal as set forth in claim 2, said foot part of the contact knife being inserted and locked into the insulation material housing of the saddle contact part.

4. The transformer terminal as set forth in claim 1, said internal connection unit of the saddle contact part having a plug uptake for making the electrical connection between the saddle contact part and the slide contact part, said external connection unit of the slide contact part having a plug-in tab which engages the plug uptake when the slide contact part is placed on the saddle contact part.

5. The transformer terminal as set forth in claim 1, said slide contact part with its insulation material housing being produced in the form of serial terminals, said insulation material housing being locked together to form a modular structured terminal block.

6. The transformer terminal as set forth in claim 1, said insulation material housing of the saddle contact part being produced in one piece with the insulation material coil unit of the transformer.

* * * * *